United States Patent [19]

Hales

[11] 4,419,548

[45] Dec. 6, 1983

[54] TIMING DEVICE AND METHOD

[76] Inventor: Paul D. Hales, 226 Woodbine St., High Point, N.C. 27264

[21] Appl. No.: 415,132

[22] Filed: Sep. 7, 1982

[51] Int. Cl.[3] ..... H01H 43/00

[52] U.S. Cl. ..... 200/38 R

[58] Field of Search ..... 200/38 R, 38 A, 38 FA, 200/38 B, 38 BA, 38 C, 38 CA

[56] References Cited

U.S. PATENT DOCUMENTS 3,287,515 11/1966 Godwin ..... 200/38 BA 3,371,170 2/1968 Thomas et al. ..... 200/38 B 3,500,005 3/1970 Brown ..... 200/38 B 3,649,783 3/1972 Voland ..... 200/38 C

*Primary Examiner*—J. R. Scott

[57] ABSTRACT

The present invention demonstrates an apparatus and method for accurately providing electrical current to appliances or the like for selected time periods. The apparatus includes a series of cam wheels which are notched and the arcuate distances between the notches on the periphery of the wheels determine the length of time the current is supplied to said appliance. A plurality of wheels is provided with notches spaced at different intervals to provide the user a variety of selectable time periods.

6 Claims, 5 Drawing Figures

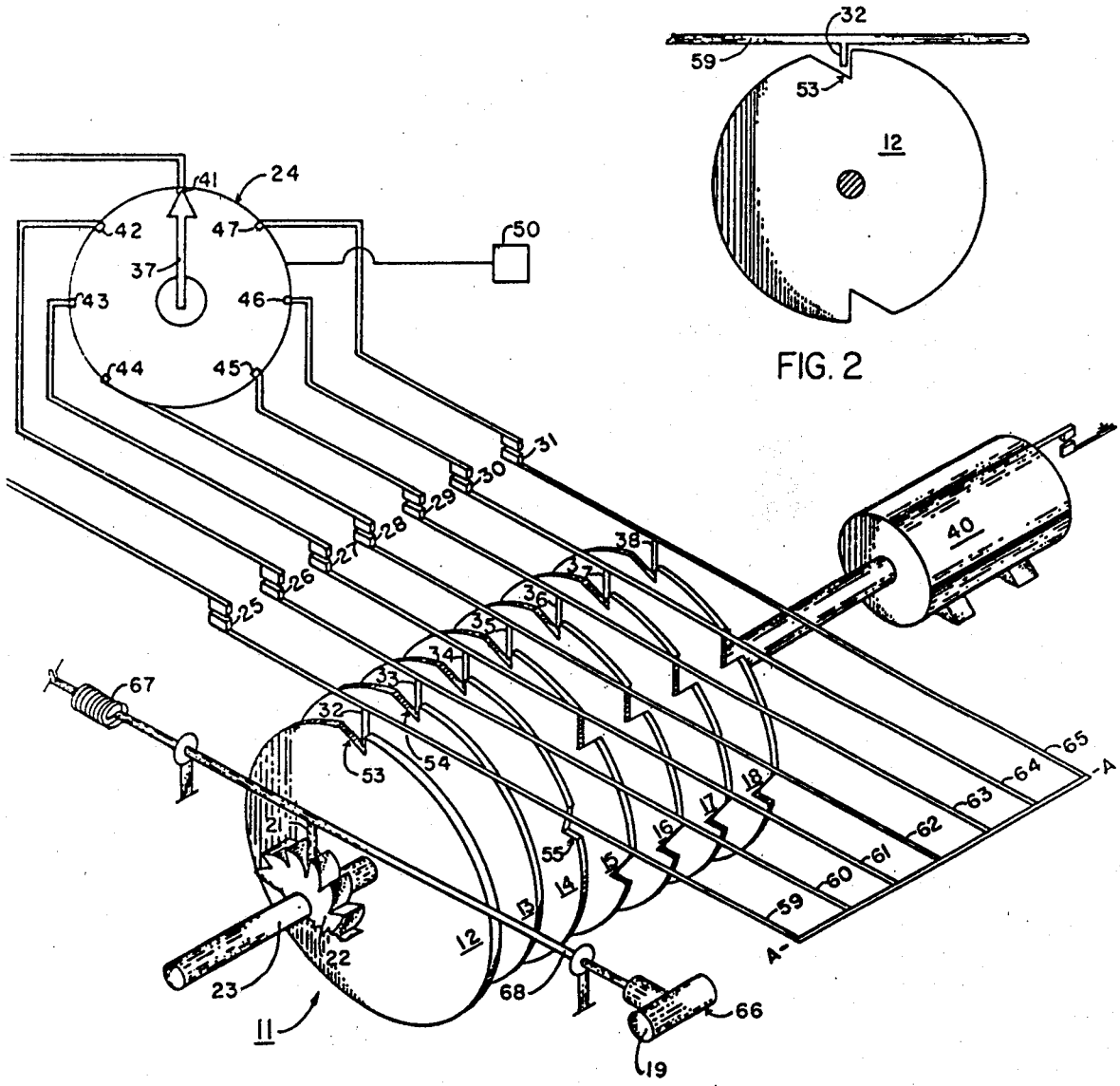
FIG. 1
FIG. 2
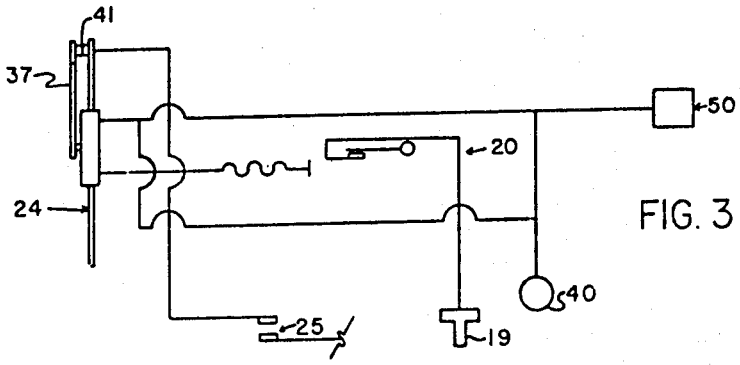
FIG. 3

TIMING DEVICE AND METHOD

BACKGROUND AND OBJECTIVES OF THE INVENTION

Description of the Prior Art

Various home appliances including heating and air-conditioning systems often require timing devices for cyclic operations. Timing devices are now sold which allow home owners to automatically turn a clock or television on for a selected time period in their absence to simulate occupancy of the house or apartment while they are away. Other devices are known which, for example turn a heating or air-conditioning on during selected time periods of the day or night to maintain a home at a minimum comfort level as shown in my pending patent application Ser. No. 383,538 filed June 1, 1982. Also, washing machines and other common household appliances including clock radios may have a timing apparatus built-in which provides the user with some type of periodic operation.

The prior art devices heretofore mentioned are generally set and operate for a prescribed cycle within a short period of time which may be, for example 24 hours. Thereafter, in the next 24 hours the same operational cycle is repeated and continues for as long as required. The disadvantages of conventional timers are apparent as for example if a lamp is connected to a timer which is activated at seven p.m. each day and is deactivated at five a.m. the following morning, a professional burglar could readily determine that the dwelling was unoccupied and being automatically illuminated. To the contrary, if the lights were being turned on and off at different times then the potential burglar would be more reluctant to enter the premises and would probably look for a more vulnerable location.

With this background and knowledge in mind the present invention was conceived and one of its objectives is to provide a timing device for appliances or the like with a plurality of selected time cycles.

It is still another objective of the present invention to provide a timing device which can be activated from a remote location.

It is still another objective of the present invention to provide a timing device which is relatively inexpensive to manufacture and which is reliable in operation.

It is yet another objective of the present invention to provide a timing device having solenoid means to activate cam wheel means contained therein for selected time periods.

It is another objective of the present invention to provide a method for supplying electrical current to appliances or the like in a dependable, economical fashion.

Various other objectives and advantages of the invention will be demonstrated below.

SUMMARY OF THE INVENTION

The invention contained herein comprises a timing apparatus and method whereby appliances or the like can be operated for selected periods of time. The apparatus includes a plurality of cam wheel means which are notched to provide various time periods for operation of the selected appliance. The timing apparatus can be manually operated or can be operated from a remote location by the use of a telephone. A selector means is provided whereby the user can choose the length of time the apparatus is to furnish electricity to an appliance and upon activation the timing apparatus continuously furnishes electricity throughout the cycle. At the completion of the cycle the apparatus is shut off and the appliance no longer receives electrical current. Upon reactivation, if the selector means is not changed the appliance again would function to the end of the selected cycle.

The preferred embodiment of the apparatus includes a plurality of cam wheel means with the surface of the outer periphery defining a series of notch means. Positioned above the cam wheel means are contact support means each having a contact means which is contiguous with the cam wheel means. As the cam wheel means rotates during operation the contact means contacts the periphery of said cam wheel means and will eventually drop into the notch means thereby opening an attached contact switch means. The contact switch means is in electrical communication with a selector means having dial means for manually selecting a desired time cycle. The preferred embodiment of the apparatus includes a plurality of seven cam wheel means which are joined to a rotatable shaft member. Driving means is provided for initiating rotation of said shaft member which includes a solenoid having a rod member which engages gear means attached to said shaft member. Electrical current supplied to said solenoid means causes said gear means to rotate thus closing the contact switch means whereby a motor means then drives said cam wheel means during the remainder of the selected cycle. The appliance or other device which is to periodically operate receives electrical current simultaneously with the motor means. As the cam wheel means rotates, contact means approaches the notched means until it drops into said notch means at which time the contact switch means opens and the timer motor ceases to run along with simultaneous termination of the operation of the appliance connected thereto.

In the preferred method of supplying electrical current to an appliance or the like, remote activation of a relay means initiates rotation of the cam means. Upon rotation of said cam means the accompanying contact switch means is closed allowing electric current to flow to a motor means which rotates the cam means during the remainder of its cycle. Rotary selector means is in communication with said cam means and with said motor means which can be manually preset to a variety of specific time intervals.

BRIEF DESCRIPTION OF THE DRAWINGS

FIG. 1 demonstrates in partial schematic fashion timing apparatus of the present invention;

FIG. 2 shows a close-up view of one cam wheel means and contact means;

FIG. 3 demonstrates a side schematic view of the selector means of the invention;

DESCRIPTION OF THE PREFERRED EMBODIMENT

Figure 4:
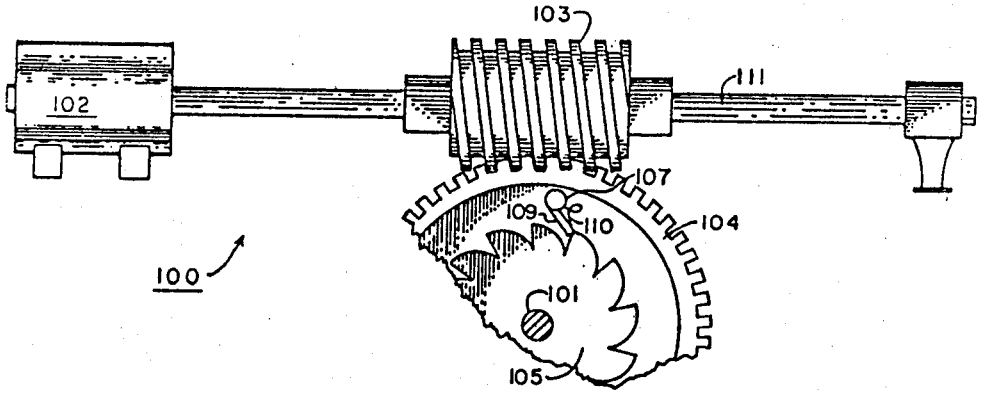
FIG. 4 demonstrates a side elevational view of an alternate embodiment of a cam driving means.

For a more detailed description of the invention, FIG. 1 illustrates the preferred embodiment of the timing device having cam means 11 including a plurality of cam wheel means 12–18. As shown, each cam wheel means is notched differently and cam wheel means 12 includes 2 notches for 24 hour time cycles whereas cam wheel means includes 24 notches for 2 hour time cycles. Cam wheel means 13 includes 4 notches for 12 hour timing cycles; cam wheel means 14 includes 6 notches for 8 hour timing cycles, cam wheel means 15 includes 8 notches for 6 hour timing cycles, cam wheel means 16 includes 12 notches for 4 hour timing cycles, and cam wheel means 17 includes 16 notches for 3 hour timing cycles. Other configurations of the notched arrangements can be provided with shorter or longer timing cycles as desired.

In operation, an electric signal of 110 volts AC is received by solenoid means 19 as shown in FIG. 1 from relay means 20 as shown in FIG. 3 which may be telephone activated as set forth in my earlier application Ser. No. 383,538 filed June 1, 1982. The activation of solenoid 19 causes rod member 68 which is attached to solenoid 19 to move from left to right as shown in FIG. 1 causing point means 21 to clockwise rotate gear means 22. Gear means 22 is similar to a typical rachet wheel and is affixed to shaft member 23. Simultaneously with current being supplied to solenoid 19, 110 volt current is also applied through points A—A from a 110 volt AC power source (not shown) in FIG. 1.

Selector means 24 is positioned in FIG. 1 to provide a time cycle of 24 hours as shown set to correlate with switch means 25 (shown opened) in FIG. 1. As further shown in FIG. 1 switch means 26–31 are shown opened. As gear means 22 rotates in a clockwise direction cam wheel means 12 which is also affixed to shaft member 22 likewise rotates causing contact means 32 to contact the periphery of cam wheel means 12 closing contact switch means 25. With contact switch means 25 closed, electrical current flows through selector dial means 37 to motor means 40 which starts and continues the clockwise rotation of cam means 11 by turning shaft member 23. Thus, the initiation of the rotating movement of cam means 11 by solenoid means 19 is continued by motor means 40 which may be a fractional horsepower 110 volt electric motor with a gear reduction mechanism to provide a very low rpm output. As further shown in FIG. 1, selector means 24 includes a series of contact points correlating with contact switch means means 25–31. As shown, dial means 37 is positioned at contact point means 41 which correlates with contact switch means 25 providing for a 24 hour timing cycle. However, dial means 37 can be positioned at contact point means 42, 43, 44, 45, 46, or 47, respectively, correlating with contact switch means 26–31 for selected time cycles of from 2 to 24 hours as desired. Manual switch means 49 is also shown in FIG. 1 joined to motor means 40 which allows timing device 10 to be manually turned on as desired. Shaft member 27 is turned by hand if desired but should not be turned in a clockwise direction as constructed in FIG. 1. Dial means 37 can be turned in either direction as required for setting.

As further shown in FIG. 1, applicance 50 which may be a heating or air-conditioning unit, electric lamp or other device receives electrical current simultaneously with motor means 40 until the end of the selected timing cycle. As it would be understood cam wheel means 12 rotates in a clockwise direction until contact means 32 drops into notch means 53 as shown in FIG. 2, and the related contact switch means (not shown in FIG. 2) is opened thus terminating power to appliance 50 and to motor means 40. Also, electrical contact which is delivered to points A—A passes along contact support means 59–65 as shown in FIG. 1 and respectively through contact switch means 25–31, provided said contact switch means are closed.

To activate timing device 10 from a remote location a telephone or other transmitting means can be utilized to close relay means 20 as shown in FIG. 3. For example, a prescribed number of telephone rings (25–30) may activate relay means 20 (with suitable equipment) which in turn directs an electrical current to cam driving means 66 as shown in FIG. 1 which includes solenoid means 19, point means 21, resilient means 67 and gear means 22. Solenoid means 19 when receiving electrical current from relay means 20 which may be for example a five pole double throw relay switch, causes cam means 11 to rotate in a clockwise direction. Simultaneously with the electrical signal being sent to solenoid means 19, electrical current is directed to points A—A and with the rotation of cam means 11, motor means 40 is activated through selector means 24 and a selected timing cycle is in operation. As would be understood, after solenoid means 19 moves rod member 68 in a left to right fashion as shown in FIG. 1, resilient member 67 urges rod member 68 back to its original position where it is poised to initiate another timing cycle when required.

Figure 5:
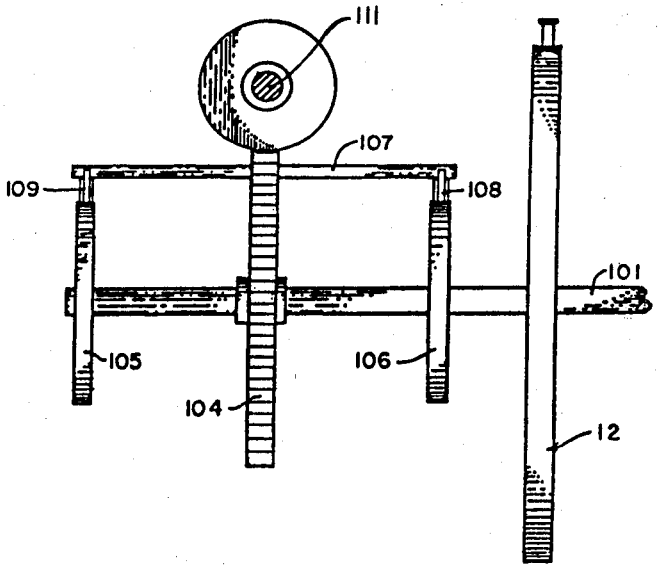
FIG. 5 illustrates a front view of the driving means of FIG. 4.

An alternate embodiment is shown in FIG. 4 wherein cam driving means 100 is shown attached to shaft member 101. Cam driving means 100 includes a 110 volt AC electric motor means 102, worm means 103, worm gear means 104, and spur gear means 105 and 106 as shown in FIG. 5. Rod means 107 is attached through worm gear means 104 and includes pivotable gear contact means 108 and 109.

As shown in FIG. 4, gear contact means 109 is rotatably mounted to rod means 107 and is maintained in a substantially downward position by spring means 110.

Cam driving means 100 can be used to initiate the movement of cam means 11 as shown in FIG. 1 as further explained herein. For example, when relay means 20 (FIG. 2) closes, an electrical current flows to motor means 102 which drives worm means 103. Worm means 103 in turn rotates worm gear means 104 which is positioned on and not rigidly attached to shaft member 101. Rod member 107 being rigidly affixed to gear means 104 therefore turns and through gear contact means 108 and 109 rotates spur gear means 105 and 106. Spur gear means 105 and 106 being securely affixed to shaft member 101, causes shaft member 101 and cam means 11 partially shown in FIG. 5 to turn, thus beginning the timing cycle. Motor means 40 (shown in FIG. 1) continues driving cam means 11 for the duration of the timing cycle. As spur gear means 105 and 106 rotate during the remainder of the timing cycle, contact means 108 and 109 are rotatably raised by the gear teeth of spur means 106 and 105 respectively and worm gear means 104 does not move during this phase.

Various modifications and changes can be made to the embodiments of the driving means shown herein or to the other components of the invention included herein and the drawings and examples presented are to illustrate and not to limit the scope of the invention.

I claim:

1. A timing device for supplying electric current to an appliance or the like during a selected cycle comprising: cam driving means, said cam driving means including solenoid means, a rod member, said rod member being affixed at one end to said solenoid means, resilient means, said resilient means being joined to the other end of said rod member, cam means, said cam means including a cam wheel means having a notched outer surface, said cam driving means for only initially rotating said cam means, contact support means, said contact support means having contact means, selector means, said selector means communicating with said contact means and motor means, said motor means joined to said cam means for continuing the rotation of said cam means after initial rotation during the remainder of the selected cycle.

2. A timing device as claimed in claim 1 and including a shaft member, said cam means positioned on said shaft member, gear means, and said gear means affixed to said shaft member.

3. A timing device as claimed in claim 2 wherein said cam driving means includes point means, said point means affixed to said rod member whereby activation of said solenoid means causes said contact means to rotate said gear means.

4. A method of supplying electric current for a selected time to an appliance or the like comprising: directing an electrical current to driving means comprising a solenoid means having a rod member attached thereto, moving said rod member in a direction to initially rotate a cam means, returning the rod means to its original position after initially rotating the cam means, thereafter providing current to the appliance while rotating the cam means by a motor means, touching the periphery of the rotating cam means with a contact means joined to a closed switch means, and opening the switch means to thereby terminate current to the appliance.

5. A method of supplying electric current as claimed in claim 4 and including the step of setting a selector means prior to providing current to the appliance.

6. A method of supplying electrical current as claimed in claim 5 wherein the step of setting a selector means comprises manually setting the selector means.

* * * * *